US006141882A

United States Patent [19]

Syken

[11] Patent Number: 6,141,882

[45] Date of Patent: Nov. 7, 2000

[54] MEASURING INSTRUMENT

[75] Inventor: Jeffrey M. Syken, Forest Hills, N.Y.

[73] Assignee: Square One Inc., Merrick, N.Y.

[21] Appl. No.: 09/121,261

[22] Filed: Jul. 23, 1998

[51] Int. Cl.[7] ..... B43L 7/12

[52] U.S. Cl. ..... 33/471; 33/455; 33/465

[58] Field of Search ..... 33/500, 499, 498, 33/497, 496, 495, 465, 471, 452, 492, 455, 468, 469, 476, 494, 483, 491

[56] References Cited

U.S. PATENT DOCUMENTS

| | | | |
|---|---|---|---|
| 1,161,761 | 11/1915 | Baker | 33/499 |
| 4,060,902 | 12/1977 | Keller | 33/403 |
| 4,446,627 | 5/1984 | Persson | 33/497 |
| 4,481,720 | 11/1984 | Sury | 33/451 |
| 4,562,649 | 1/1986 | Ciavarella | 33/419 |
| 4,757,616 | 7/1988 | Hills | 33/488 |
| 4,920,658 | 5/1990 | Hile | 33/499 |
| 5,020,233 | 6/1991 | Syken | 33/465 |
| 5,208,992 | 5/1993 | Syken | 33/472 |
| 5,459,935 | 10/1995 | Paulson et al. | 33/451 |
| 5,475,931 | 12/1995 | Wei | 33/471 |
| 5,687,628 | 11/1997 | Liao | 83/745 |

FOREIGN PATENT DOCUMENTS

| | | | |
|---|---|---|---|
| 474890 | 7/1951 | Canada | 33/492 |

OTHER PUBLICATIONS

Pp. 10–13 from the Dietzgen catalog dated Feb. 2, 1959.

*Primary Examiner*—Andrew H. Hirshfeld
*Assistant Examiner*—R. Alexander Smith
*Attorney, Agent, or Firm*—Ezra Sutton

[57] ABSTRACT

An improved measuring instrument for use with drawings employing different scales with indicia thereon; wherein, the measuring instrument includes a pair of elongated first and second instrument member arms having top walls and bottom walls and having opposite ends wherein one pair of ends are adapted to be releasably and pivotally connected to one another. The measuring instrument further includes a rotatble ratchet connection assembly associated with the first and second instrument member arms for captively but releasably engaging the first and second instrument member arms in both an L and an inverted L configuration. The tops walls of the first and second instrument member arms having beveled edges with indicia thereon, for preventing the indicia from engaging the measured or drawn surfaces when in use; and the bottom walls of the first and second instrument member arms having inclined planes with indicia thereon for preventing the indicia from engaging the measured or drawn surfaces when in use. The indicia are calibrated and are operatively associated with the top and bottom walls of the first and second instrument member arms.

13 Claims, 9 Drawing Sheets

MEASURING INSTRUMENT

FIELD OF THE INVENTION

The present invention relates to the field of measuring instruments in general, and in particular to a multiple purpose, and multi-mode measuring apparatus having selectable scale indicia, as well as an improved multi-position locking capability.

BACKGROUND OF THE INVENTION

Measuring devices of various types, such as carpenter squares, retractable scaled measuring tapes, bevel squares, protractor instruments, scale dividers, architect scales, and the like are well known in the prior art. In general, the aforementioned instruments lack versatility, are unable to give a precise means for setting a specific angle to be measured, and the measurement scales on a given instrument are limited (four or less). Retractable scaled measuring tapes in particular are limited to only two scales and only one directional measure, vertical and/or horizontal can be achieved in a given movement by the user. The architect scales are mono-directional and are difficult to measure quickly. For example, for drafting and/or measuring purposes of a specific configuration, the architect's scale holds only two scales on each face (i.e. from left to right and right to left) which overlap one another thus making quick measurements confusing and awkward by the user.

There remains a need for an improved measuring instrument that provides for an increased number of selectable measuring scales for multiple mode measurements having multiple scale indicia thereon, as well as an auxiliary function of providing an improved multi-positioning locking assembly for providing a precise means for setting the measuring instrument to measure a specific angle by degrees.

DESCRIPTION OF THE PRIOR ART

Measuring instruments, drawing instruments, guiding devices, measuring tools, angle gauges, drafting apparatus and aids, and framing tools and the like having various designs, structures, configurations, and materials of construction have been disclosed in the prior art. For example, U.S. Pat. Nos. 5,020,233 and 5,208,992 to Syken discloses a measuring instrument having male and female members being rotatably connected at one end to form a right-angle L-shaped configuration. Each of the male and female members are rotatable via a rotatable connection through a 180° range to form an inverted L-shaped configuration; and each of the male and female members have multi-mode measuring scales on each face of the male and female members. The rotatable connection is capable of a 90° degree locking capabilities. These prior art patents do not disclose the structure and configuration of the present invention.

U.S. Pat. No. 397,128 to Hester discloses a scale measure. This measuring instrument indicates the angle(s) at which the end of rafters that must be cut in the construction of gable-roofed houses. The measuring instrument includes a pair of legs swiveled together, and one of the legs provided with a notched sector plate, and the other leg having a spring-actuated pawl. The legs of the measuring scale are able to rotate 90° degrees relative to each other. This prior art patent does not teach or disclose the design, structure, configuration or function of the present invention.

U.S. Pat. No. 5,392,525 to Chow discloses a drawing instrument which includes a pair of rulers each having a head portion, where a circular protrusion is formed on one of the head portions, and a circular recess is formed on the other head portion for slidable engagement with the circular protrusion. The rulers are guided to rotate relative to each other by the slidable engagement between the circular protrusion and the circular recess. This prior art patent does not disclose the design, structure and configuration of the present invention.

U.S. Pat. Nos. 397,128; 593,608; 3,343,265; 3,635,396; 4,097,999; 4,223,445; 4,446,627; 4,451,993; 4,562,649; 5,675,901 and 5,687,628 disclose a diverse variety of angularly adjustable measuring instruments. None of these aforementioned prior art patents disclose the design, structure and configuration of the present invention.

These prior art patents do not disclose or teach the use of a measuring instrument having a plurality of measuring scales and a multiple positioning locking assembly having an adjustable ratchet member therein for measuring a specific angles by degrees, as shown in the design and configuration of the present invention.

Accordingly, it is an object of the present invention to provide a measuring instrument that is multi-purpose having selectable scale indicia thereon for increased multi-mode measuring capabilities, and an improved multi-position locking capability for measuring of specific angles by degrees.

Another object of the present invention is to provide a measuring instrument that has multi-purpose use by architects, builders, carpenters, contractors, draftsmen, engineers, model makers, woodworkers and the like which allows for accurate and repeatable measurements during operational use.

Another object of the present invention is to provide a measuring instrument that is compact, portable, user-friendly, easy to use on paper, blueprints, construction materials, models and the like by the user.

Another object of the present invention is to provide a measuring instrument that allows for at least eight (8) bi-directional measuring scales having scale indicia thereon.

Another object of the present invention is to provide a measuring instrument that has an improved multi-positioning locking capability using a ratchet-type rotatable assembly which provides for specific measurement of a selected angle within a 180° rotation.

Another object of the present invention is to provide a measuring instrument that includes inclined planes on the reverse side of each of the measuring arms in order to keep the indicia off of the measured/drawn surface(s) when in use, thus reducing wear to the reverse-side scales.

Another object of the present invention is to provide a measuring instrument that includes beveled edges on the top/upper side of each of the measuring arms in order to keep the indicia off of the measured/drawn surface(s) when in use, thus reducing wear to the top side primary scales.

Another object of the present invention is to provide a measuring instrument that include stepped surfaces on the top side (primary scale) of each of the measuring arms in order to provide an easy visual transition whereby the secondary scales on the top side of each measuring arm can be read off of the primary scales via the integrated (visual) indicia markings.

Another object of the present invention is to provide a measuring instrument that can be taken apart whereby the reverse side scales (auxiliary) can be used independently in a standard (mono-directional) fashion for each part (A/B).

A further object of the present invention is to provide a measuring instrument that can be mass produced in an automated and economical manner and is readily affordable by the user.

SUMMARY OF THE INVENTION

In accordance with the present invention, there is provided an improved measuring instrument for use with drawings employing different scales with indicia thereon. The measuring instrument includes a pair of elongated first and second instrument member arms having top walls and bottom walls and having opposite ends wherein one pair of ends are adapted to be releasably and pivotally connected to one another. The measuring instrument further includes a rotatble ratchet connection assembly associated with the first and second instrument member arms for captively but releasably engaging the first and second instrument member arms in both an L and an inverted L configuration. The tops walls of the first and second instrument member arms having beveled edges with indicia thereon, for preventing the indicia from engaging the measured or drawn surfaces when in use; and the bottom walls of the first and second instrument member arms having inclined planes with indicia thereon for preventing the indicia from engaging the measured or drawn surfaces when in use. The indicia are calibrated and are operatively associated with the top and bottom walls of the first and second instrument member arms.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
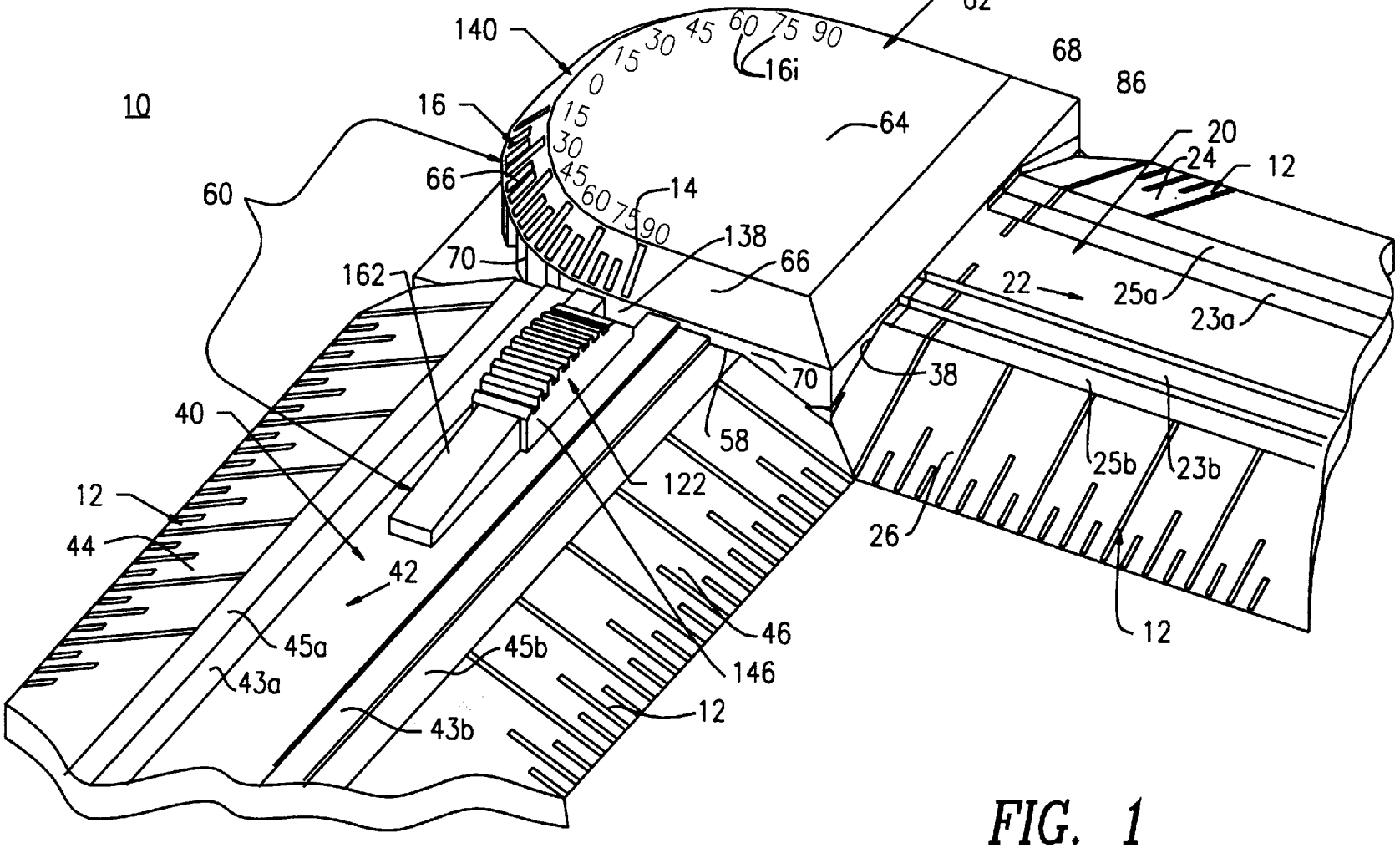
FIG. 1 is an enlarged partial top front perspective view of the measuring instrument of the preferred embodiment of the present invention showing the major component parts contained therein; in an assembled L-shaped configuration and in an operational mode.
Figure 7:
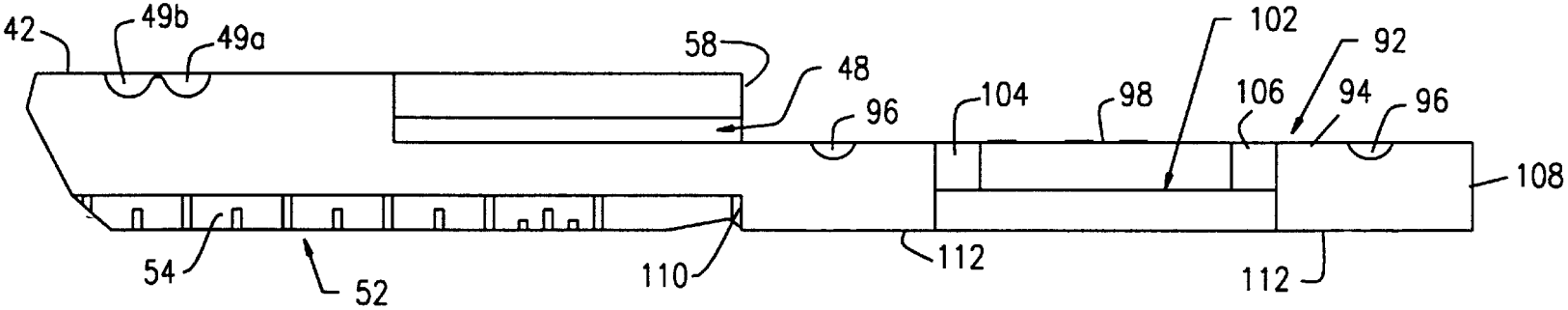
FIG. 7 is a partial side cross-sectional view of the measuring instrument of the present invention taken along lines 7—7 of FIG. 4 showing the female instrument member, the lower ratchet component having a pair of spherical receiving receptacles/sockets and a receiving plate component for the ratchet adjustment member therein.
Figure 8:
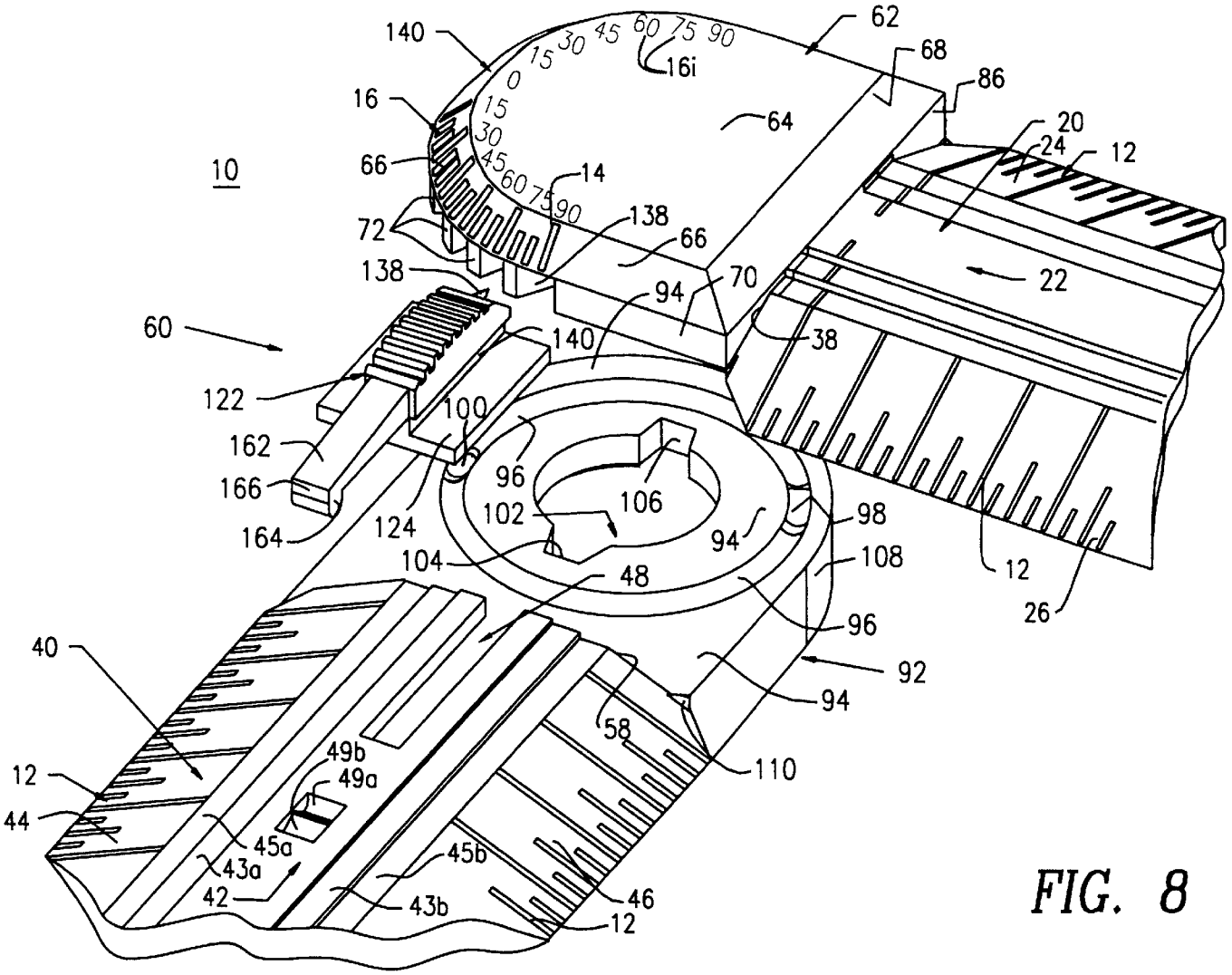
FIG. 8 is an enlarged exploded top front perspective view of the measuring instrument of the present invention showing the partial male instrument member, the ratchet adjustment member and the partial female instrument member.
Figure 9:
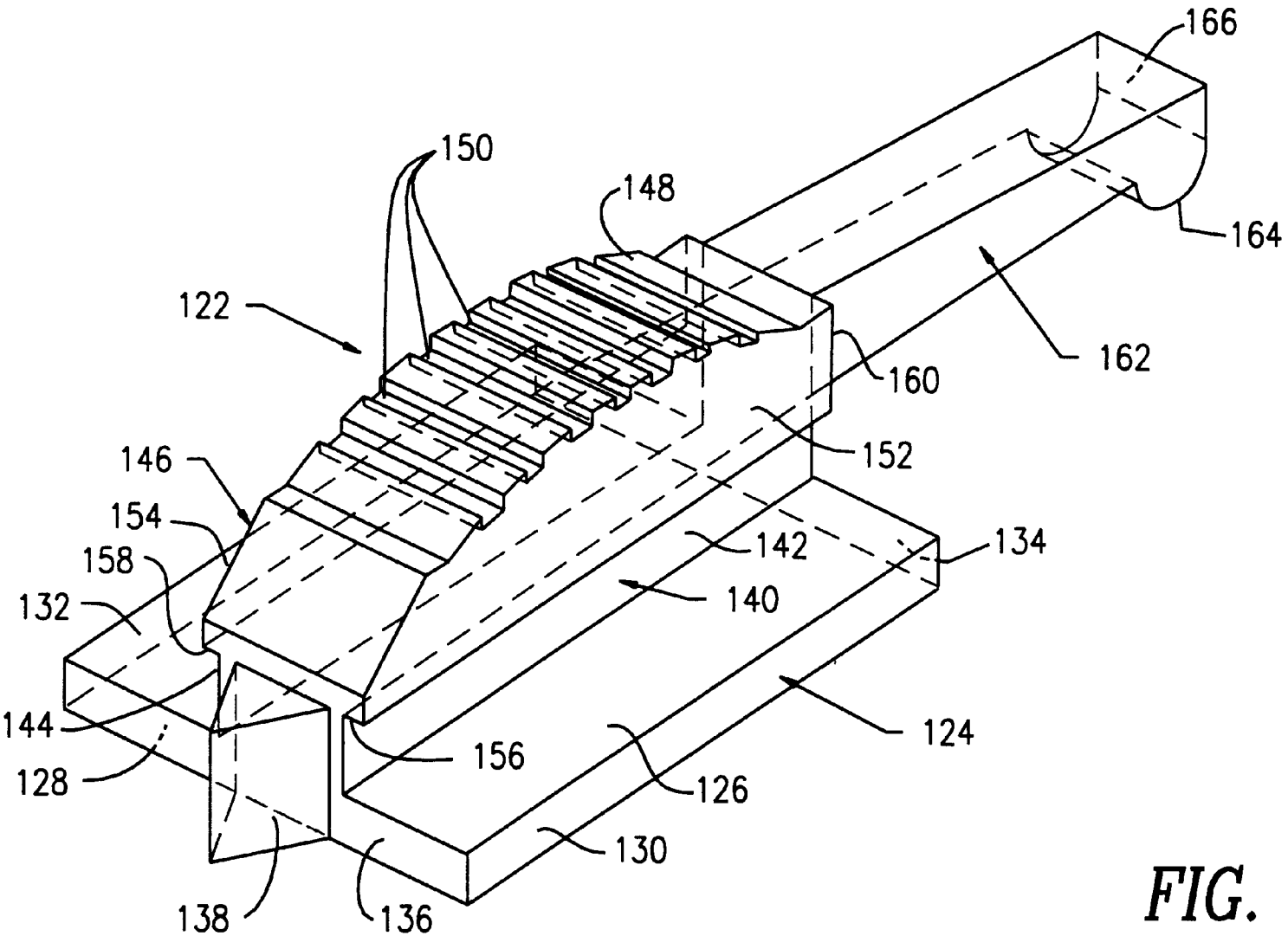
FIG. 9 is an enlarged top front perspective view of the measuring instrument of the present invention showing the ratchet adjustment member.
Figure 10:
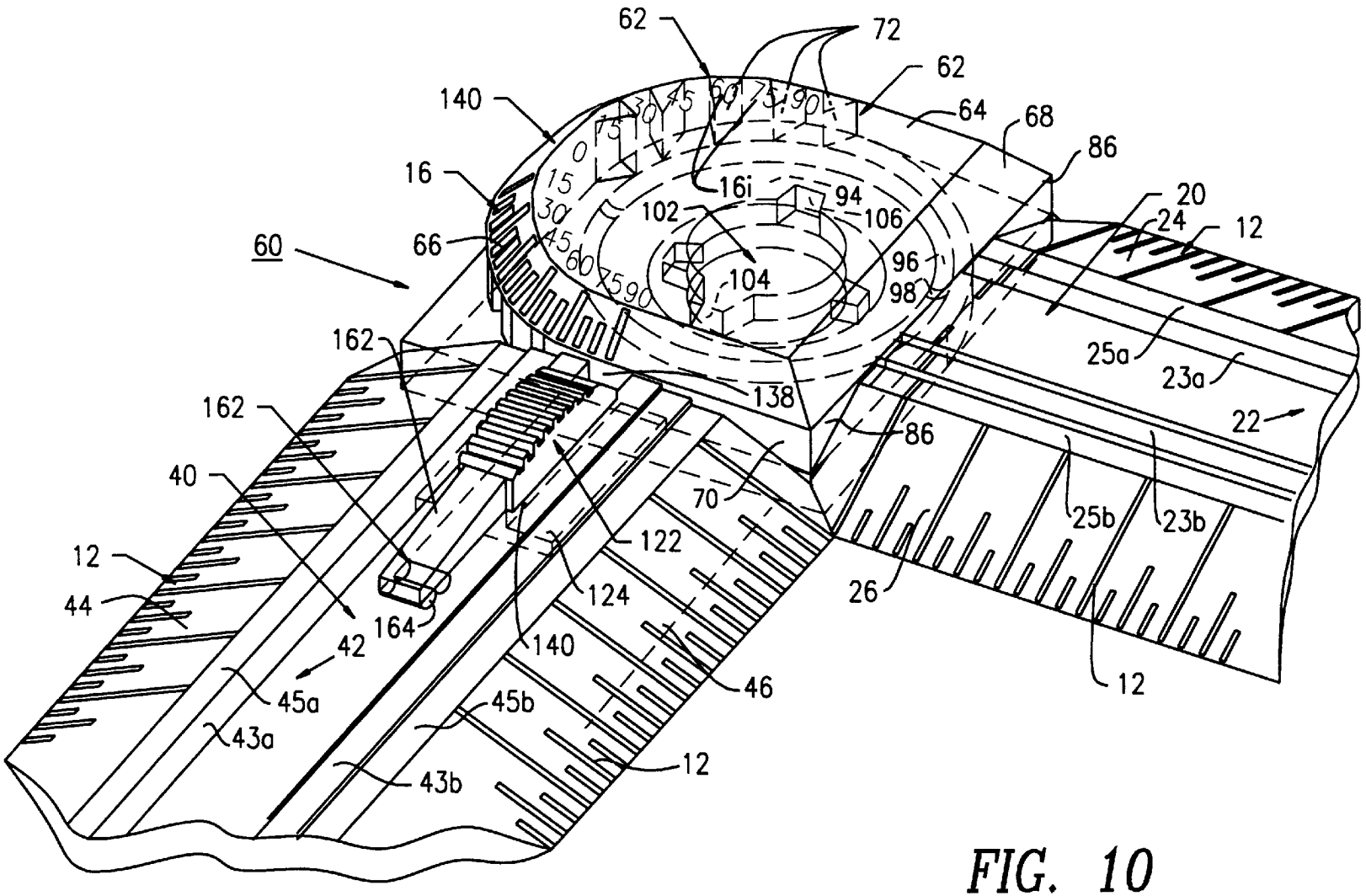
FIG. 10 is an enlarged partial top front perspective view of the measuring instrument of the present invention showing the interlocking relationship of the male and female instrument members with the ratchet adjustment member in an assembled configuration and in an operational mode.

The measuring instrument 10 and its component parts of the preferred embodiment of the present invention are represented in detail by FIGS. 1 through 12 of the drawings. The measuring instrument 10, as shown in FIGS. 1, 8 and 10 includes a male (first) instrument member 20, a female (second) instrument member 40 and a rotatable ratchet connection assembly 60. Measuring instrument 10 can be made of plastic or light-weight metal. As shown in FIGS. 1, 10, 11 and 12 the measuring instrument 10 is in an operational mode for measuring along a specific linear scale 12 and/or for measuring a specific degree of angle 14 on a rotatable scale 16 having indicia 16*i* thereon for use as a protractor function.

Figure 2:
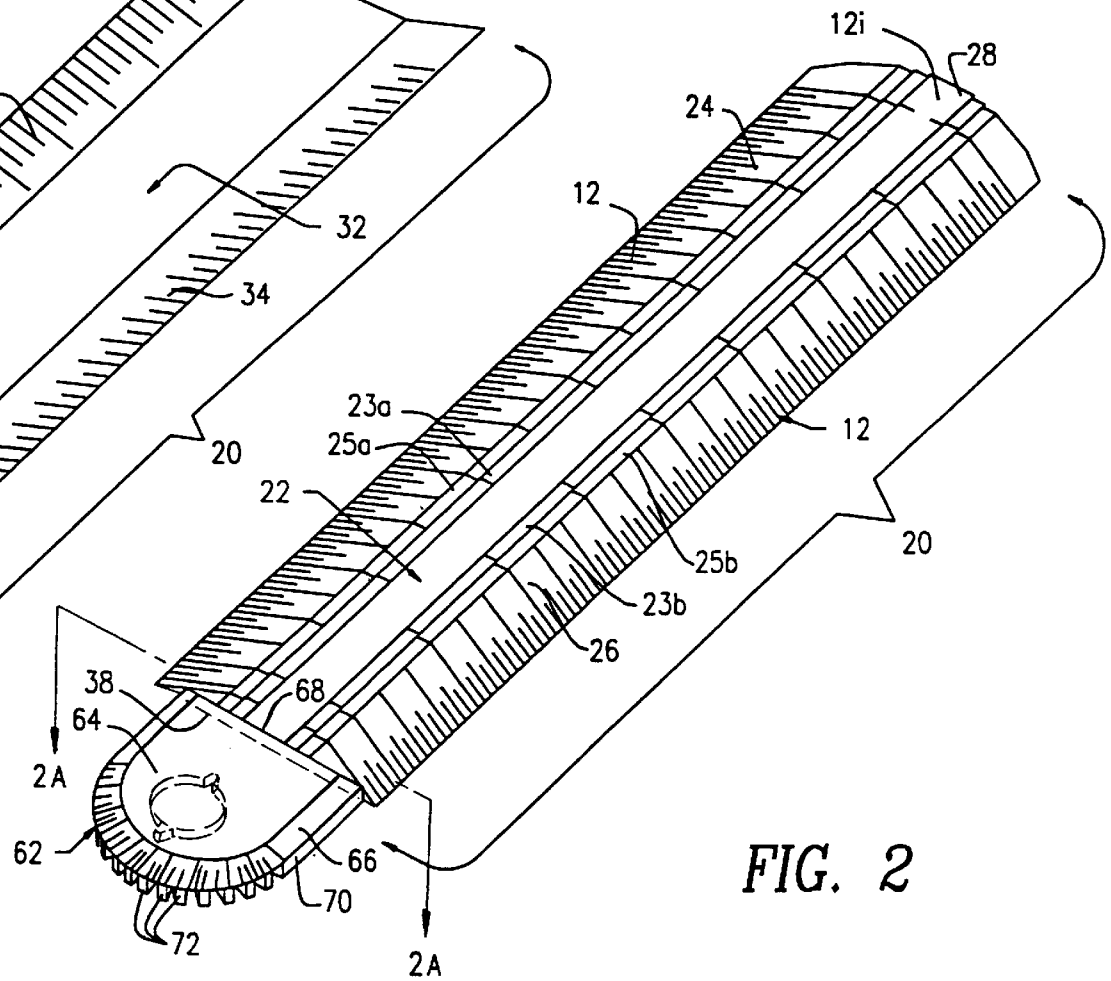
FIG. 2 is a top front perspective view of the measuring instrument of the present invention showing the male (Part A) instrument member and the upper ratchet component having a plurality of teeth receiving slots thereon.
Figure 3:
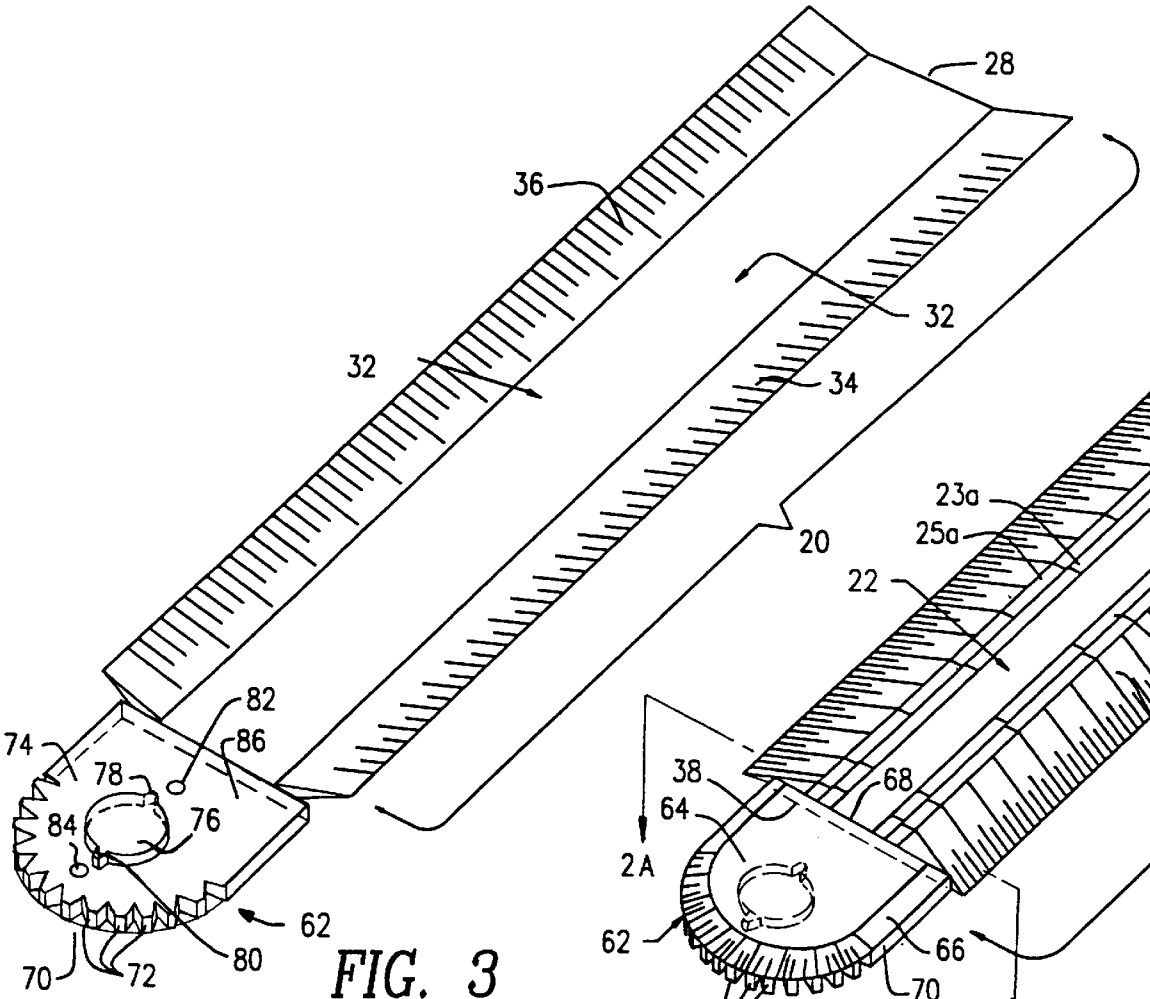
FIG. 3 is a bottom rear perspective view of the measuring instrument of the present invention showing the male (Part A) instrument member and the upper ratchet component having a plurality of teeth receiving slots thereon.
Figure 2A:
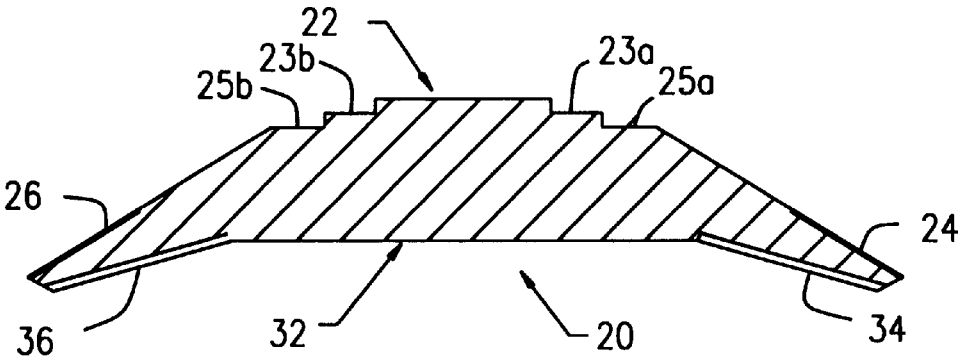
FIG. 2A is a cross-sectional view of the measuring instrument of the present invention taken along lines 2A—2A of FIG. 2 showing the inclined planes on the reverse side scales and the beveled edges on the top side primary scales of the male instrument member.
Figure 4A:
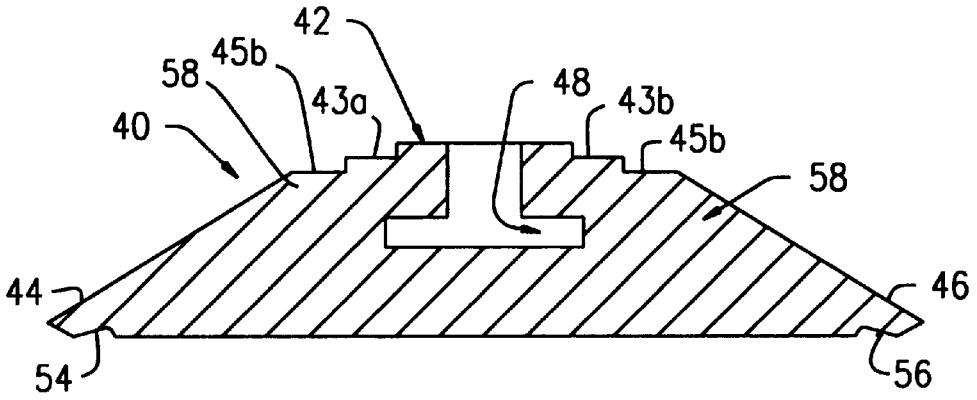
FIG. 4A is a cross-sectional view of the measuring instrument of the present invention taken along lines 4A—4A of FIG. 4 showing the inverted T-shaped receiving sleeve, the beveled edges on the top side primary scales, and the inclined planes on the reverse side scales of the female instrument member.

The male instrument member 20, as shown in FIGS. 2 and 3 of the drawings, includes a top wall surface 22 having a pair of beveled side-edge sections 24 and 26 with linear measurement scales 12, an outer end wall 28, a bottom wall surface 32 having a pair of beveled side-edge sections 34 and 36 with linear measurement scales 12, and an inner end wall section 38 which integrally attaches to the upper ratchet component 62.

Figures 4, 5:
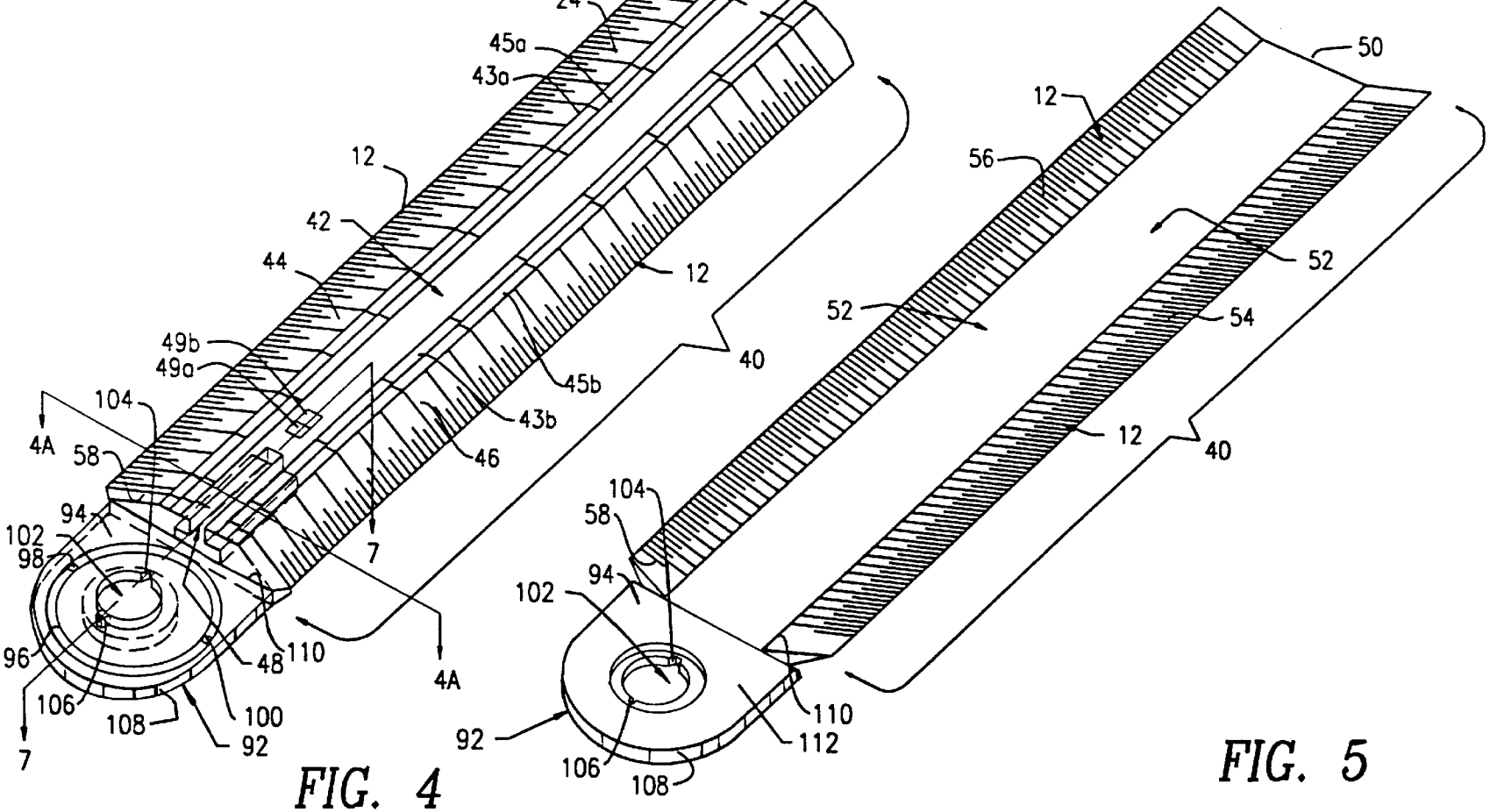
FIG. 4 is a top front perspective view of the measuring instrument of the present invention showing the female (Part B) instrument member and the lower ratchet component having a pair of spherical receiving receptacles/sockets therein.
FIG. 5 is a bottom rear perspective view of the measuring instrument of the present invention showing the female (Part B) instrument member and the lower ratchet component having a pair of spherical receiving receptacles/sockets therein.
Figure 6:
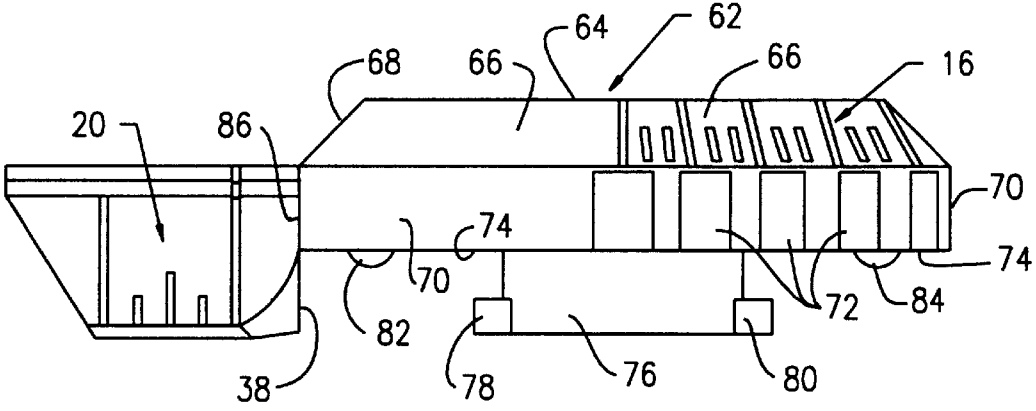
FIG. 6 is a partial side elevational view of the measuring instrument of the present invention showing the male instrument member and the upper ratchet component having a plurality of teeth receiving slots thereon.

The female instrument member 40, as shown in FIGS. 4 and 5 of the drawings, includes a top wall surface 42 having a pair of beveled side-edge sections 44 and 46 with linear measurement scales 12, an outer end wall 50, a bottom wall surface 52 having a pair of beveled side-edge sections 54 and 56 with linear measurement scales 12 having indicia thereon, and an inner end wall section 58 which integrally attaches to the lower ratchet component 92. Top wall surface 42 further includes an inverted T-shaped receiving sleeve 48 for receiving the base and connecting components 124 and 140 of the ratchet adjustment member 122 therein, and a cylindrical receiving slots 49*a* and 49*b* for receiving the bottom cylindrical tab 164 of handle member 162 of the ratchet adjustment member 122 therein. Receiving sleeve 48 is adjacent and within the inner end wall section 58, as depicted by FIGS. 7, 8 and 10 of the drawings.

Figure 11:
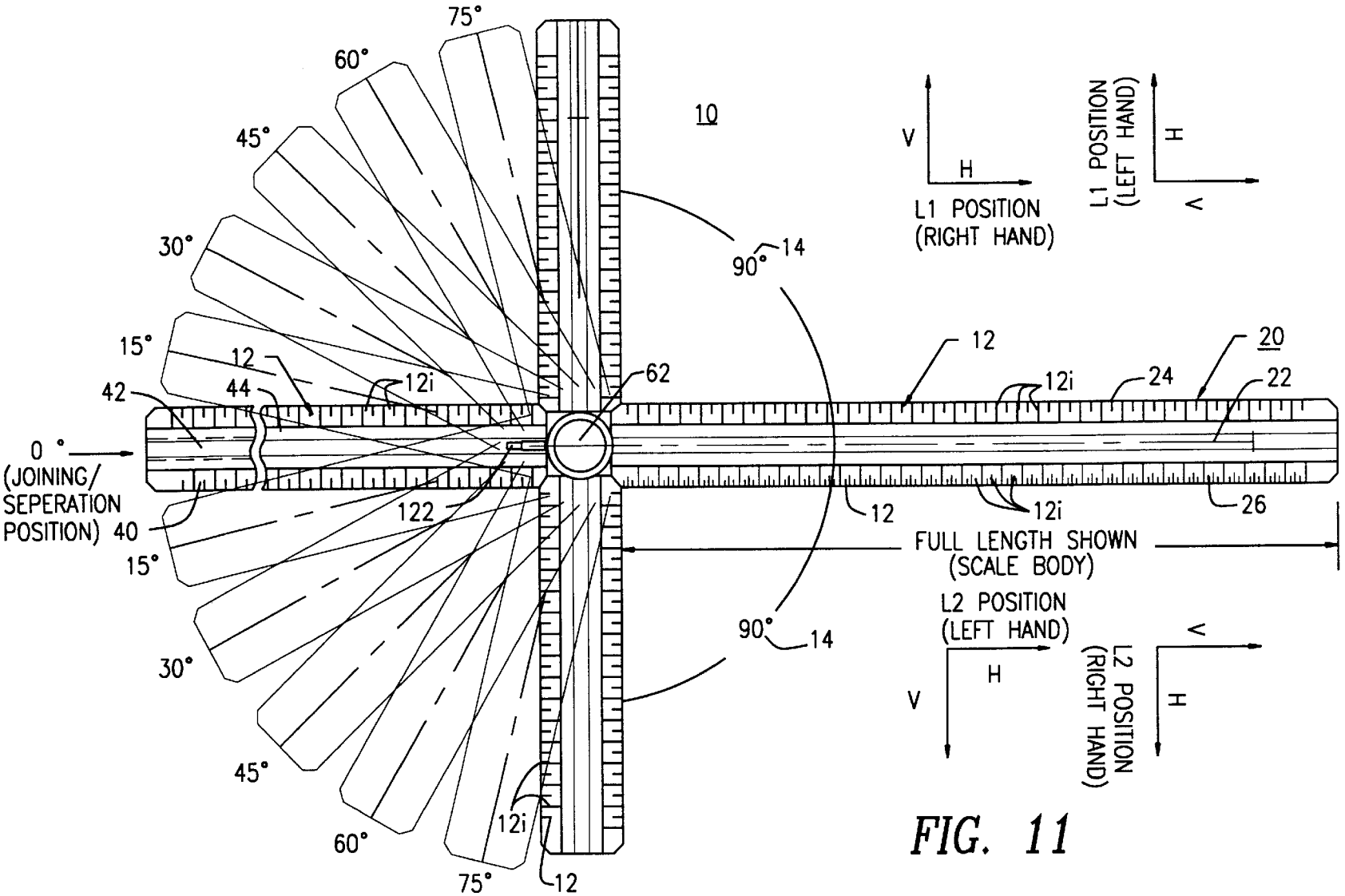
FIG. 11 is a top plan view of the measuring instrument of the present invention showing multiple locking positions of the female instrument member for measuring a specific angle via the rotatable ratchet connection assembly being in an operational mode.

The rotatable ratchet connection assembly 60, as shown in FIGS. 1, 8 and 10 of the drawings, includes an upper ratchet component 62, a lower ratchet component 92 and a ratchet adjustment member 122 for rotatably moving each of the male and female instrument members 20 and 40 relative to each other in a 180° arc. The measuring instrument 10, as shown in FIG. 11, allows each male or female instrument member 20 or 40 to move in 180° arc relative to the other member.

The upper ratchet component 62 of the rotatable ratchet connection assembly 60, as depicted in FIGS. 2, 3, 6, 8 and 10 of the drawings, includes a top wall surface 64 having a U-shaped beveled side-edge section 66 and having an inner beveled side-edge section 68, an outer curved perimeter sidewall surface 70 having a plurality of wedge-shaped teeth receiving slots 72 therein, a bottom wall surface 74 having a center connecting member 76 with diametrically opposed connecting tabs 78 and 80 thereon, and an inner sidewall surface 86 for integrally attaching to the inner end wall section 38 of the male instrument member 20. The plurality of wedge-shaped teeth receiving slots 72 are aligned in a U-shaped fashion along the perimeter sidewall 70 and are integrally attached to the bottom wall surface 74, as depicted in FIG. 3 of the drawings. Bottom wall surface 74 also includes a pair of diametrically opposed spherical connecting tabs 82 and 84 for receiving within the first annular recessed ring 96 of the lower ratchet component 92, as depicted in FIGS. 3 and 4 of the drawings, and tabs 82 and 84 being adjacent to the center connecting member 76.

The lower ratchet component 92 of the rotatable ratchet connection assembly 60, as depicted in FIGS. 4, 5, 7, 8 and 10 of the drawings, includes a top wall surface 94 having a first annular recessed ring 96 therein, a center opening 102 having diametrically opposed connecting receptacles 104 and 106 therein, an outer perimeter sidewall 108, an inner sidewall surface 110 for integrally attaching to the inner end wall section 58 of the female instrument member 40 and a bottom wall surface 112. The first annular recessed ring 96 is U-shaped and further includes a pair of diametrically opposed recessed spherical sockets 98 and 100 for interchangeably receiving of the spherical connecting tabs 82 and 84 of the upper ratchet component 62, as depicted in FIGS. 1, 3, 4, 6, 7 and 12 of the drawings, for the locking of the male and female instrument members 20 and 40 in 90° degree angled positions. The lower ratchet component 92 of the rotatable ratchet connection assembly, as shown in FIGS. 5 and 7, further includes a bottom wall surface 112.

The ratchet adjustment member 122 of the rotatable ratchet connection assembly 60, as depicted in FIGS. 1 and 8 to 11 of the drawings, includes a base component 124 being integrally attached to a connecting component 140, the connecting component 140 being integrally attached to an upper component 146 having a handle member 162 thereon. The base component 124 includes a top wall 126, a bottom wall 128, sidewalls 130 and 132, a rear wall 134 and a front wall 136 having an interlocking wedge-shaped tab 138 thereon. Wedge-shaped tab 138 is centrally located on front wall 136, as shown in FIG. 9 of the drawings. Wedge-shaped tab 138 is received within any one of the plurality of wedge-shaped teeth receiving slots 72 for locking the male and female instrument members 20 and 40 (relative to each other) in a particular position, as shown in FIG. 12 of the drawings. The connecting component 140 of ratchet adjustment member 122 includes sidewalls 142 and 144 which are received within the receiving sleeve 46 of female instrument member 40. The upper component 146 of ratchet adjustment member 122 includes a curved top wall surface 148 having a plurality of square-tooth thumbgrip slots 150 therein, sidewalls 152 and 154, bottom wall edges 156 and 158, a rear wall surface 160 having a handle member 162 thereon. Handle member 162 includes a bottom cylindrical tab 164 located at the end wall area 166, as depicted in FIG. 9 of the drawings. Cylindrical tab 164 of handle member 162 is received within the cylindrical receiving slots 49*a* or 49*b* for stopping any lateral movement of the ratchet adjustment member 122 within the receiving sleeve 48 of female instrument member 40, as shown in FIG. 10 of the drawings.

Operation of the Invention

In operation, the measuring instrument 10 is intended to be used as a user-friendly and ready-to-use measuring, drawing, and is drafting tool for use on paper, blueprints, construction materials, models and the like by the user. The measuring instrument 10 includes two essentially similar male and female instrument members 20 and 40 where the two members 20 and 40 can only be joined and/or separated in a position whereby the ratchet components 62 and 92 of each member 20 and 40, respectively, are in 180° opposition to one another in the same plane. The ratchet components 62 and 92 (radius end(s)) form a lap-joint whereby a wedge-shaped tab 138 of the ratchet adjustment member 122 engages the wedge-shaped teeth receiving slots 72 of male instrument member 20, in order to provide a specific angle 14 of member 20 relative to member 40. Rotation of one part about the other past this joining/separating position renders the two members 20 and 40 inseparable. Once joined, the user may select five(5) "modes" of operation, as depicted in FIG. 11 of the drawings. These modes of operation are as follows:

Mode No. 1

Rotation of one instrument member 20 or 40 part about the other instrument member 40 or 20, respectively to form a 90° interface whereby primary and multiple secondary scales are available for integrated, bi-directional use. The indicia 16*i* on the top and bottom walls 22, 42, 32 and 52 of the first and second instrument member arms 20 and 40, respectively, are calibrated and are operatively associated (the calibrated indicia) with each other (linear scales 12) for making a mechanical drawing by a user.

Mode No. 2

Same as Mode No. 1 except for the inverted rotation to form a second position whereby additional primary/secondary scales are available for integrated, bi-directional use. The indicia 16*i* on the top and bottom walls 22, 42, 32 and 52 of the first and second instrument member arms 20 and 40, respectively, are calibrated and are operatively associated (the calibrated indicia) with each other (linear scales 12) for making a mechanical drawing by a user.

Mode No. 3

An auxiliary protractor function designed to set and hold-in-place securely angles 14 formed at 15° intervals via a ratchet adjustment member 122 (thumbslide/gear mechanism) that is integral to the upper ratchet component 62 [radius end (gears)] and removably connected to the female instrument member 40. This mode of operation is a voluntary function available for use in the 180° rotation between Mode No. 1 and Mode No. 2, as distinctly shown in FIG. 12 of the drawings.

Mode No. 4

Like Mode No. 3, an auxiliary protractor function whereby angles 14 can be set at 5° intervals except, the angle cannot be held securely in place via the ratchet adjustment member 122 as in Mode No. 3, as it is done by line-of-sight manual measurement by the user. It is a useful reference feature.

Mode No. 5

An auxiliary function whereby the members 20 and 40 are separated from one another and the back of reverse side scales can be used individually for standard mono-directional use.

Additionally, it should be noted that as an integral function of Mode No. 1 and Mode No. 2, an autolock mechanism secures the two member parts 20 and 40 at the 90° position (s) via an integral annular recessed ring 96 having diametrically opposed recessed spherical sockets 98 and 100 therein are molded into the top wall surface 94 of the lower ratchet component 92 and a pair of spherical connecting tabs 82 and 84 molded into underside bottom wall surface 74 of upper ratchet component 62, such that tabs 82 and 84 interchangeably fit into sockets 98 and 100, respectively. The interfitting of tabs 82 and 84 with sockets 98 and 100 of the first annular ring 96 at opposite ends at the 90° position(s) autolock's the two member parts 20 and 40 at either 90° position(s), as shown in FIGS. 1, 10 and 11. Moderate applied axial pressure serves to secure the 90° position(s) and/or disengage the autolock. As well, the ratchet adjustment member 122 (Mode No. 3) has a 90° position and can be voluntarily engaged to ensure additional resistance to applied axial pressure.

In summary, the means for releasably locking the first and second instrument member arms 20 and 40 in 90° degree positions includes a pair of diametrically opposed spherical connecting tabs 82 and 84 on the bottom wall 72 of the upper ratchet component 62 for interchangeably receiving them within a pair of diametrically opposed recessed spherical sockets 98 and 100 of the annular recessed ring 96, respectively, in order to releasably lock the instrument member arms 20 and 40 in 90° degree positions for an L configuration and an inverted L configuration, as shown in FIG. 11 of the drawings.

Regarding Mode No. 3, it is worth noting that this protractor function is wholly voluntary and the engagement and/or disengagement of the ratchet adjustment member 122 is strictly at the users discretion. The ratchet adjustment member 122 has two positions only, the first being a retracted position and the second being an engaged position. The integral bottom cylindrical tab 164 extends from the back of the handle member 162 of the ratchet adjustment member 22 and rests in depressions slots 49*a* and 49*b* molded into the top wall surface 42 of female instrument member 40. The rear depression slot 49*b* is the retracted position and the forward depression slot 49*a* is the engaged position. Frictional force holds the bottom cylindrical tab 164 in position. Moderate lateral pressure on the thumb slots 150 moves the ratchet adjustment member 122 into either position. It is important for rotational transition from Mode No. 1 and Mode No. 2 and vice-versa to be smooth, quick and unobstructed without any wear on the ratchet adjustment member 122.

The measurement scales 12 of each member part 20 and 40 contain indicia which can be set in an alternating pattern whereby always one-half (½) of the numbers on all scales 12 are upright to the user. This feature allows for flexibility in the positioning/orientation of the measuring instrument 10 when in an operational mode. For example, a right-handed person will hold the device in their left hand in an 'L' configuration whereas a left-handed person will do the opposite, thus creating an inverted 'L' position, as shown in FIG. 11 of the drawings.

The top wall surfaces 22 and 42 of each member 20 and 40, respectively, has a primary scale set on the bevel side-edge sections 24, 26, 44 and 46 on either side of each member 20 and 40, respectively for it's entire length. Adjoining the primary scale on the beveled side-edge sections 24, 26, 44 and 46 lengths are multiple secondary scales on the flat adjoining lengths of each the male and female instrument members 20 and 40. The beveled side-edge sections 24, 26, 42 and 46 keep the indicia off of the measured/drawn surface(s), thus reducing wear to the primary side scales 12 on the top wall surfaces 22 and 42, respectively.

To help distinguish the secondaries from one another, successive 'steps' 23*a*, 23*b*, 25*a*, 25*b*, 43*a*, 43*b*, 45*a* and 45*b* for each of the secondary scales are integral to each of the members 20 and 40, respectively for their entire lengths, as shown in FIGS. 2 and 4 of the drawings. Each of the sides 22, 32, 42 and 52 of the male and female instrument members 20 and 40 receives a different 'set' of scales 12. The primary scale (bevel) provides the transition whereby the secondaries can be read off of the primary via integrated indicia markings. For example, if the primary scale is ¼"=1'–0" then the first secondary could be ½"=1–0", second secondary could be 1"=1–0" etc. Thus, every two ¼" markings equals one ½" marking and every four ¼" marking equals one 1" marking etc.

A variety of scale types can be incorporated into the design. For example there can be an Architectural version featuring either the English or the Metric system. Likewise there can be an engineering or map scale versions, etc. The outer edge of each part on both sides of the members 20 and 40 feature a 'chisel' edge for their entire length(s). As well, the corners of each part's members 20 and 40 are chamfered at 45°. This allows complimentary joining of the two member part's 0-0 positions in Mode's No. 1 and/or No. 2 (90°) and for the outer chamfer at the terminal ends, 28 and 50 of members 20 and 40, as it protects the corners from wear.

The reverse bottom wall surfaces 32 and 52 of each part's members 20 and 40, respectively are hollowed-out. This wing shape allows for inclined planes 34, 36, 54 and 56 on either side of each of the male and female instrument members 20 and 40, respectively. On these inclined planes 34, 36, 54 and 56 are auxiliary scales set in left-to-right fashion for standard mono-directional use. The inclined planes 34, 36, 54 and 56 keep the indicia off of the measured/drawn surface(s), thus reducing wear to the reverse side scales 12, as shown in FIGS. 3 and 5 of the drawings.

As described in the preceding text, the measuring instrument 10 is useful as drafting and design aid and it is unique in it's usability, compactness, light-weight and diversity of use. When used in conjunction with a parallel edge or a T-Square, the entire surface of a measured/drawn area is quickly and efficiently exposed to bi-directional scale measure. The measuring instrument 10 can be made in various lengths, where the first and second instrument member arms 20 and 40 have various lengths such as 6", 9", 12" etc. for different engineering, architectural and drafting functions.

Advantages of the Present Invention

Accordingly, an advantage of the present invention is that it provides for a measuring instrument that is multi-purpose having selectable scale indicia thereon for increased multi-mode measuring capabilities, and an improved multi-position locking capability for measuring of specific angles by degrees.

Another advantage of the present invention is that it provides for a measuring instrument that has multi-purpose use by architects, builders, carpenters, contractors, draftsmen, engineers, model makers, woodworkers and the like which allows for accurate and repeatable measurements during operational use.

Another advantage of the present invention is that it provides for a measuring instrument that is compact, portable, user-friendly, easy to use on paper, blueprints, construction materials, models and the like by the user.

Another advantage of the present invention is that it provides for a measuring instrument that allows for at least twelve (12) measuring scales having scale indicia thereon, being eight (8) bi-directional and four (4) mono-directional.

Another advantage of the present invention is that it provides for a measuring instrument that has an improved multi-positioning locking capability using a ratchet-type rotatable assembly which provides for specific measurement of a selected angle within a 180° rotation.

Another advantage of the present invention is that it provides for a measuring instrument that includes inclined planes on the reverse side of each of the measuring arms in order to keep the indicia off of the measured/drawn surface (s) when in use, thus reducing wear to the reverse-side scales.

Another advantage of the present invention is that it provides for a measuring instrument that includes beveled edges on the top/upper side of each of the measuring arms in order to keep the indicia off of the measured/drawn surface(s) when in use, thus reducing wear to the top side primary scales.

Another advantage of the present invention is that it provides for a measuring instrument that include stepped surfaces on the top side (primary scale) of each of the measuring arms in order to provide an easy visual transition whereby the secondary scales on the top side of each measuring arm can be read off of the primary scales via the integrated (visual) indicia markings.

Another advantage of the present invention is that it provides for a measuring instrument that can be taken apart whereby the reverse side scales (auxiliary) can be used independently in a standard (mono-directional) fashion for each part (A/B).

A further advantage of the present invention is that it provides for a measuring instrument that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed:

1. A measuring instrument having different scales with indicia thereon for use with drawings, comprising:

a) one pair of elongated first and second instrument member arms having top walls and bottom walls and each of said member arms having opposite and adjacent ends, wherein said adjacent ends are adapted to be releasably and pivotally connected to one another;

b) a rotatable ratchet connection assembly on said first and second instrument member arms for detachably connecting said first and second instrument member arms; said ratchet connection assembly including an upper ratchet component on said adjacent end of said first instrument member arm and a lower ratchet component on said adjacent end of said second instrument member arm; and c) means for releasably locking said first and second instrument member arms in 90 degree positions, said means for releasably locking including a pair of diametrically opposed spherical connecting tabs on the bottom wall of said upper ratchet component for interchangeably being received within a pair of diametrically opposed recessed spherical sockets of an annular recessed ring on said lower ratchet component, respectively, for releasably locking said instrument member arms in said 90 degree positions for an L configuration and an inverted L configuration.

2. A measuring instrument having different scales with indicia thereon for use with drawings, comprising:

a) one pair of elongated first and second instrument member arms having top walls with indicia thereon, and each of said member arms having opposite and adjacent ends, wherein said adjacent ends are adapted to be releasably and pivotally connected to one another;

b) a rotatable ratchet connection assembly on said first and second instrument member arms for detachably connecting said first and second instrument member arms;

c) said rotatable ratchet connection assembly including an upper ratchet component on said adjacent end of said first instrument member arm, a lower ratchet component on said adjacent end of said second instrument member arm, and a ratchet adjustment member for rotatably moving each of said first and second instrument member arms relative to each other in a 180 degree arc; and d) said upper ratchet component including a center connecting member having diametrically opposed connecting tabs thereon, and said lower ratchet component including an annular center opening having diametrically opposed connecting receptacles therein; wherein said diametrically opposed connecting tabs of said center connecting member are detachably received within said diametrically opposed connecting receptacles of said annular center opening for detachably connecting said first and second instrument member arms.

3. A measuring instrument in accordance with claim 2, wherein said indicia are calibrated on said top walls for drawing use by a user.

4. A measuring instrument in accordance with claim 2, wherein each of said first and second instrument member arms includes a bottom wall, and wherein said indicia is imprinted on said top and bottom walls of said first and second instrument member arms.

5. A measuring instrument in accordance with claim 2, wherein said indicia are imprinted on beveled edges of said top walls of said first and second instrument member arms.

6. A measuring instrument in accordance with claim 2, wherein each of said first and second instrument member arms includes a bottom wall having inclined planes, and wherein said indicia are imprinted on said inclined planes of said bottom walls of said first and second instrument member arms.

7. A measuring instrument in accordance with claim 2, wherein said upper ratchet component includes said indicia for measuring a specific degree of an angle on a rotatable scale on said upper ratchet component for use as a protractor function.

8. A measuring instrument in accordance with claim 2, further including means for releasably locking said first and second instrument member arms in either of two 90 degree positions.

9. A measuring instrument in accordance with claim 8, wherein said means for releasably locking said first and second instrument member arms include a pair of diametrically opposed spherical connecting tabs on said bottom wall of said upper ratchet component for interchangeably being received within a pair of diametrically opposed recessed spherical sockets of an annular recessed ring, respectively, in order to releasably lock said instrument member arms in said 90 degree positions for an L configuration and an inverted L configuration.

10. A measuring instrument in accordance with claim 2, wherein said top walls of each of said first and second instrument member arms further include at least one pair of stepped surfaces in order to provide a visual transition between a pair of secondary scales on said top walls of each of said instrument member arms and a pair of primary scales on said top walls.

11. A measuring instrument in accordance with claim 2, wherein said measuring instrument is made of plastic or light-weight metals.

12. A measuring instrument in accordance with claim 2, wherein said top walls of said first and second instrument member arms have beveled edges with said indicia thereon for preventing said indicia from engaging measured or drawn surfaces when in use.

13. A measuring instrument in accordance with claim 2, wherein said bottom walls of said first and second instrument member arms have inclined planes with said indicia thereon for preventing said indicia from engaging measured or drawn surfaces when in use.

* * * * *